US006874336B2

(12) United States Patent
Yarborough et al.

(10) Patent No.: US 6,874,336 B2
(45) Date of Patent: Apr. 5, 2005

(54) CUT RESISTANT, WICKING AND THERMOREGULATING FABRIC AND ARTICLES MADE THEREFROM

(75) Inventors: Portia D. Yarborough, Midlothian, VA (US); Heather Lyn Anne Johnstone, Ontario (CA); Gregory S. Parker, Glen Allen, VA (US); Larry John Prickett, Chesterfield, VA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 114 days.

(21) Appl. No.: 10/603,467

(22) Filed: Jun. 25, 2003

(65) Prior Publication Data

US 2004/0261465 A1 Dec. 30, 2004

(51) Int. Cl.[7] ..... D04B 7/34
(52) U.S. Cl. ..... 66/174; 66/202; 2/16
(58) Field of Search ..... 2/2.5, 16, 167; 66/169 R, 170, 171, 174, 196, 202; 442/308–311

(56) References Cited

U.S. PATENT DOCUMENTS 4,470,251 A * 9/1984 Bettcher ..... 66/174
4,912,781 A * 4/1990 Robins et al. ..... 2/2.5
5,113,532 A 5/1992 Sutton
5,965,223 A * 10/1999 Andrews et al. ..... 2/167
6,132,871 A 10/2000 Andrews
6,155,084 A 12/2000 Andrews et al.
6,161,400 A * 12/2000 Hummel ..... 66/174
6,534,175 B1 3/2003 Zhu et al.
2002/0010695 A1 1/2002 Howland

FOREIGN PATENT DOCUMENTS

WO WO 01/98572 6/2001

* cited by examiner

*Primary Examiner*—Danny Worrell

(57) ABSTRACT

A knitted fabric, such as present in a glove, provides cut resistance, wicking of moisture and thermo regulating properties. The fabric is made with at least one bundle of at least one yarn wherein the yarn comprises at least two strands: at least one of the strands in the bundle having a sheath/core construction with a sheath of cut resistant staple fibers and a metal fiber core; and at least one of the strands in the bundle having cut resistant aramid fibers and being free from metal fibers.

16 Claims, No Drawings

CUT RESISTANT, WICKING AND THERMOREGULATING FABRIC AND ARTICLES MADE THEREFROM

BACKGROUND OF THE INVENTION

Workers handling sharp tools in cold temperature environments require protective gloves with multiple functionality including cut resistance, insulation, moisture management and dexterity. The main risk to the majority of workers in this type of environment is the mechanical hazard from cuts and abrasions from sharp tools. Cut resistant gloves are used, however, the cut resistant gloves do not address the other needs of the worker. The body's circulation slows in cold temperatures resulting in a loss of feeling, grip, dexterity and overall efficiency.

Currently, workers in these environments wear several glove layers to meet the needs of the job task. A glove is worn to maintain warm hands, another glove to provide cut resistance, and other gloves are worn as needed to obtain the level of comfort required for the job.

Cut resistant gloves are typically composed of yarns having limited moisture wicking ability. Yarn properties have a tendency to become more rigid and inflexible the higher the cut resistance of the yarn. Wearing several layers of gloves creates a bulky structure on the hand. Bulky layers compromise a worker's dexterity and thereby impact worker productivity.

WO 01/98572 discloses a cut resistant fabric with strands having a sheath of cut resistant staple fibers and a metal fiber core.

U.S. Pat. No. 6,155,084 discloses protective articles such as a glove or sleeve made of a composite fabric of one region with cut resistant yarn and another region of yarn providing tactile sensitivity or providing protection against varying harmful effects.

U.S. Pat. No. 6,534,175 discloses a comfortable cut resistant fabric with metal fibers shielded from abrasive exposure by a cut resistant staple fiber wrapping.

There is a need for a multifunctional fabric such as formed into a glove that combines the aspects of cut resistance, insulation, moisture management and dexterity into one glove. Also, there is a need for a thermoregulating fabric useful in an environment where insulation is not needed.

SUMMARY OF THE INVENTION

The present invention is directed to a knitted fabric suitable to provide cut resistance and moisture transport having two opposite faces with:

(a) a first face comprising (i) strands of a sheath/core construction with a sheath of cut resistant fibers and a metal core and (ii) hydrophilic fibers and (b) a second face comprising hydrophilic fibers with the proviso that the strands of the sheath/core construction are not present on the second face and the further proviso that hydrophilic fibers extend from the second face to the first face.

In a preferred embodiment of the invention the knitted fabric, such as present as a portion of a glove for use in a cold environment has a cut resistance of at least 4000 grams (on a face having sheath/core cut-resistant fibers), a moisture permeability index of at least 0.50 and a thermal resistance of at least 0.60 clo.

DETAILED DESCRIPTION

In the present invention a knitted fabric provides cut resistance such as to knives on a first face and provides an ability to wick moisture from an opposite, second face to the first face. The fabric is thermoregulating which denotes in a construction with a minimum amount of fabric material heat transfer (such as from a person's perspiration) can take place and in a construction with sufficient fabric provides an insulating property. Furthermore, the knitted fabric with sufficient fabric material provides thermal resistance which allows the fabric to be used in a cold environment.

An example of the use of the knitted fabric is as a glove such as in a cold, meat cutting environment. The glove on a first, outer face provides protection from a knife blade. Additionally, the fabric on a second, inner face, in contact with a human hand allows perspiration to wick across the inner face to the outer face. Also, the knitted glove provides protection against cold due to resistance to heat transport.

On one face of the knitted fabric it is necessary to have a combination of (a) cut resistant fibers as a sheath in combination with a core of metal fibers, and (b) hydrophilic fibers (also present on an opposite face).

Cut resistance fibers are well-known in the art with suitable examples polyamide fibers, polyolefin fibers, polybenzoxazole fibers, polybenzothiazole fibers, poly{2,6-diimidazo[4,5-b4',5'-e]pyridinylene-1,4(2,5-dihydroxy)phenylene} (PIPD) fiber, or mixtures thereof. Preferably, the fibers are made of polyamide.

When the polymer is polyamide, aramid is preferred. By "aramid" is meant a polyamide wherein at least 85% of the amide (—CO—NH—) linkages are attached directly to two aromatic rings. Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938, 3,869,429, 3,819,587, 3,673,143; 3,354,127; and 3,094,511.

Additives can be used with the aramid and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride or the aramid.

The preferred aramid is a para-aramid and poly(p-phenylene terephthalamide)(PPD-T) is the preferred para-aramid. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride or 3,4'-diaminodiphenylether.

When the polymer is polyolefin, polyethylene or polypropylene are preferred. By polyethylene is meant a predominantly linear polyethylene material of preferably more than one million molecular weight that may contain minor amounts of chain branching or comonomers not exceeding 5 modifying units per 100 main chain carbon atoms, and that may also contain admixed therewith not more than about 50 weight percent of one or more polymeric additives such as alkene-1-polymers, in particular low density polyethylene, propylene, and the like, or low molecular weight additives such as anti-oxidants, lubricants, ultra-violet screening agents, colorants and the like which are commonly incorporated. Such is commonly known as extended chain polyethylene (ECPE). Similarly, polypropylene is a predominantly linear polypropylene material of preferably more than one million molecular weight. High molecular weight linear polyolefin fibers are commercially available. Preparation of polyolefin fibers is discussed in U.S. Pat. No. 4,457,985.

Polybenzoxazole (PBO) and polybenzothiazole (PBZ) are suitable, such as described in WO 93/20400. While the aromatic groups joined to the nitrogen atoms may be heterocyclic, they are preferably carbocyclic; and while they may be fused or unfused polycyclic systems, they are preferably single six-membered rings. While the group in the main chain of the bis-azoles is the preferred paraphenylene group, that group may be replaced by any divalent organic group which doesn't interfere with preparation of the polymer, or no group at all. For example, that group may be aliphatic up to twelve carbon atoms, tolylene, biphenylene, bis-phenylene ether, and the like.

The polybenzoxazole and polybenzothiazole used to make fibers of this invention generally have at least 25 and preferably at least 100 repetitive units. Preparation of the polymers and spinning of those polymers is disclosed in International Publication WO 93/20400.

The above cut resistant fibers are present as a sheath on a core of metal, present as fibers or a wire preferably made of a ductile metal such as stainless steel, copper, aluminum, bronze, and the like. Stainless steel is the preferred metal. The metal fibers are generally continuous wires. The metal fibers are preferably 10 to 150 micrometers in diameter, and are more preferably 25 to 75 micrometers in diameter. The cut resistant fibers may be continuous or staple. For many applications staple fibers are preferred.

A wicking fiber is necessary on the opposite face of the knitted fabric wherein no metal is present. The wicking fiber is hydrophilic with the ability to transport moisture from a face which is in contact with a person to the other face which contains the sheath/core construction providing cut resistance. Examples of suitable hydrophilic materials include polyester, nylon, acrylic and fibers that have been rendered hydrophilic such as through a surface coating.

The final knitted fabric generally will have a cut resistance on a fabric face which contains the sheath/core construction of at least 4000 g, more preferably 4600 g and, most preferably 5500 g measured in accordance with ASTM F1790-97.

The use of hydrophilic fibers which extends from one face of the fabric to an opposite face generally results in a moisture permeability index ($i_m$) of at least 0.50 indicating the effect of evaporating skin moisture on heat loss as in the case of a sweating skin condition, preferably at least 0.60 and, more preferably 0.70 (on a scale of 0 being impermeable and 1 being completely permeable). A fabric will not be completely permeable although an open mesh fabric could have a value close to 1.

Thermal resistance (clo) and the permeability index ($i_m$) can be from Thermolabo instrument data measured according to ASTM F1868 "Test method for Thermal and Evaporative Resistance of Clothing Materials Using a Sweating Hot Plate". The Thermolabo instrument is used to assess energy dissipation and measurement of transient heat transfer. The Thermolabo consists of three components including (1) a box containing a thin copper heat capacitor fitted with a temperature sensing device used for measuring the amount of heat and rate of heat flow through fabric specimens during testing, (2) a water-box with constant temperature water flow provides the constant temperature base needed for the procedure; and (3) an insulated hot plate fitted into a box with temperature control.

Thermal resistance (clo) equals (1/Dry heat transfer)/0.155 where dry heat transfer rate is given in watts/m$^2$° C.

Permeability index is defined as the ratio of the thermal and evaporative resistance of the fabric to the ratio of the thermal and evaporative resistance of air. The permeability index can be calculated using the following equation:

$$i_m=0.0607(E/H)(Ts-Ta)/(Ps-Pa)$$

where

E=heat transfer rate due to the moisture evaporation

H=heat transfer rate due to heat $T_s$=temperature on the hot plate surface (35° C.)

$T_a$=temperature of the ambient environment $P_s$=water vapor pressure on the hot plate surface $P_a$=water vapor pressure in the ambient environment.

Generally, the knitted fabric for use in a cold temperature environment such as a glove in a cold meat cutting environment will have a thermal resistance of at least 0.50 clo, preferably at least 0.62 clo and, more preferably 0.72 clo. An example of a thickness of the knitted fabric to provide such thermal resistance is 3.60 mm. For use in warm environments the amount of fabric thickness will be minimized consistent with a requirement to provide cut resistance.

To further illustrate the present invention the following examples are provided. All parts and percentages are by weight and temperatures in degrees centigrade unless otherwise indicated.

Test Methods

Thermal Resistance and Permeability Index:

Thermal resistance (clo) and permeability index were determined in accordance with the procedure previously discussed.

Cut Resistance:

The cut resistance was measured according to ASTM F1790-97. A small rectangular glove material specimen was placed on a metal mandrel of the cut test device. A blade was moved across the specimen until cut-through is achieved. The device measures the distance of blade travel before cut-through as determined by when the blade makes contact with the metal mandrel. The distance of blade travel is determined with different weights on the device arm holding the blade. The results of these tests are then used to determine the weight required to cut through the glove material with 25 mm blade travel. Larger values reported by this test method indicate a material with greater cut resistance.

In the following examples Kevlar® 970 ES represents a sheath-core yarn produced by ring-spinning two ends of the poly(p-phenyleneterepthalamide) roving and inserting the steel core (35 micrometer steel monofilament) just prior to twisting then plying the yarn with a 10/2 strand of yarn made of poly(p-phenyleneterepthalamide) while Coolmax® represents polyester fibers with a high moisture wicking capability and moisture evaporation properties based on the fiber cross section.

EXAMPLE 1

Pile Jersey Knit

In pile jersey knit fabrics, the yarn used for the ground is knit into a standard jersey construction and is placed on the technical face. The pile can vary based on loop density and length. The pile yarn is placed on the technical back.

In this example, two ends of a highly flexible cut resistant yarn (KEVLAR® 970 ES) were used in the ground to form the technical face. One end of a yarn having moisture management properties (CoolMax®) was used for the pile. The fabric properties are outlined below.

| Pile jersey knit | Clo | Permeability index | Cut resistance, g |
|---|---|---|---|
| | 0.86 | 0.61 | 4800 |

EXAMPLE 2

Cross Tuck Jersey

Cross tuck jersey knits are composed of repeats on a minimum of two courses and tuck loops alternate with knitted loops within a course and between one course and another. Each yarn knits and tucks at adjacent wales. In the next course the stitch that was previously tucked is knitted and vice versa. The technical face has a jersey knit construction and the technical back has a honeycomb effect.

In this example, two ends of a highly flexible cut resistant yarn (KEVLAR® 970 ES) were used in combination with a yarn having good moisture management properties (CoolMax®). The fabric properties are outlined below.

| Cross tuck jersey | Clo | Permeability index | Cut resistance, g |
|---|---|---|---|
| | 0.62 | 0.51 | 4430 |

EXAMPLE 3

Jacquard Jersey Knit

Jacquard jersey knits contain two or more yarns to give a construction consisting of knit, float and tuck loops. The fabric has two layers of yarn but not two layers of loops. This gives the second layer independent mobility related to the first layer.

In this example, three ends of a highly flexible cut resistant yarn (KEVLAR® 970 ES) were used to create the first layer comprising the technical face. The second layer was composed of a yarn having high moisture evaporation properties (CoolMax®) and formed the technical back using float and tuck stitches. The fabric properties are outlined below:

| Jacquard jersey knit | Clo | Permeability index | Cut resistance, g |
|---|---|---|---|
| | 0.72 | 0.56 | 5900 |

What is claimed is:

1. A knitted fabric suitable to provide thermal resistance, moisture transport and cut resistance having two opposite faces with:

(a) a first face comprising (i) strands of a sheath/core construction with a sheath of cut-resistant fibers and a metal core and (ii) hydrophilic fibers and (b) a second face comprising hydrophilic fibers with the proviso that the strands of the sheath/core construction are not present on the second face and the further proviso that hydrophylic fibers extend from the second face to the first face.

2. The knitted fabric of claim 1 wherein the cut resistant fibers comprise aramid.

3. The knitted fabric of claim 1 wherein the cut resistance fibers comprise polyethylene.

4. The knitted fabric of claim 1 wherein the cut resistance fibers comprise staple fibers.

5. The knitted fabric of claim 1 wherein the metal core comprises a ductile metal.

6. The knitted fabric of claim 5 wherein the metal is stainless steel.

7. The knitted fabric of claim 1 wherein the hydrophilic fibers comprise polyester.

8. The knitted fabric of claim 1 wherein the first face has a cut resistance of at least 4000 g measured in accordance with ASTM F1790-97.

9. The knitted fabric of claim 1 wherein the fabric has a thermal resistance of at least 0.50 clo.

10. The knitted fabric of claim 1 wherein the fabric has a permeability index of at least 0.50.

11. A knitted fabric suitable to provide thermal resistance, moisture transport and cut resistance having two opposite faces with:

(a) a first face comprising (i) strands of a sheath/core construction with a sheath of cut-resistant fibers and a metal core and (ii) hydrophilic fibers and (b) a second face comprising hydrophilic fibers with the proviso that the strands of the sheath/core construction are not present on the second face and the further proviso that hydrophylic fibers extend from the second face to the first face, wherein the fabric has a cut resistance on a first face of at least 4000 g measured in accordance with ASTM F1790-97, and a permeability index of at least 0.50.

12. The knitted fabric of claim 11 with a thermal resistance of at least 0.50.

13. The knitted fabric of claim 1 present as an article of clothing.

14. The knitted fabric of claim 13 present as a glove.

15. The knitted fabric of claim 11 present as an article of clothing.

16. The knitted fabric of claim 15 present as a glove.

* * * * *